US009187277B2

(12) United States Patent
Shiokawa

(10) Patent No.: US 9,187,277 B2
(45) Date of Patent: Nov. 17, 2015

(54) POST-PROCESSING APPARATUS AND IMAGE FORMING SYSTEM

(71) Applicant: KONICA MINOLTA, INC., Chiyoda-ku, Tokyo (JP)

(72) Inventor: Tsuyoshi Shiokawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/183,380

(22) Filed: Feb. 18, 2014

(65) Prior Publication Data

US 2014/0234055 A1 Aug. 21, 2014

(30) Foreign Application Priority Data

Feb. 19, 2013 (JP) ..... 2013-030339

(51) Int. Cl.

*B65H 5/32* (2006.01)
*B42C 5/00* (2006.01)
*B42B 4/00* (2006.01)
(Continued)

(52) U.S. Cl.

CPC .. *B65H 5/32* (2013.01); *B42B 4/00* (2013.01); *B42C 1/12* (2013.01); *B42C 5/00* (2013.01); *B42C 13/00* (2013.01); *B65H 45/18* (2013.01); *G03G 15/6541* (2013.01); *B31F 1/0035* (2013.01); *B65H 2301/322* (2013.01); *B65H 2301/422* (2013.01); *B65H 2301/436* (2013.01); *B65H 2301/4479* (2013.01);
(Continued)

(58) Field of Classification Search

CPC ..... B65H 5/32; B65H 2301/436; B65H 2301/4479; B65H 2301/44795; B65H 2301/422; B65H 2301/515; B31F 1/0035
USPC ..... 270/45, 52.26, 52.29, 58.07; 412/9, 16, 412/18
See application file for complete search history.

(56) References Cited

U.S. PATENT DOCUMENTS 5,377,965 A * 1/1995 Mandel et al. ..... 270/37
6,568,668 B1 5/2003 Wakabayashi et al.
(Continued)

FOREIGN PATENT DOCUMENTS

JP 07179262 A 7/1995
JP 2000143088 A 5/2000
(Continued)

OTHER PUBLICATIONS

Japanese Office Action dated Jan. 27, 2015, issued in counterpart Japanese Application No. 2013-030339.

*Primary Examiner* — Leslie A Nicholson, III
(74) *Attorney, Agent, or Firm* — Holtz, Holtz, Goodman & Chick PC

(57) ABSTRACT

A post-processing apparatus includes a suspension member that suspends a center-folded booklet by being inserted into the booklet along a fold of the booklet, a pair of clamp members that are disposed so as to face outer surfaces of the booklet suspended by the suspension member and that clamp the booklet by moving closer to each other, and a post-processing mechanism that performs a post-processing operation on the booklet clamped by the clamp members. The suspension member includes an upwardly tapering portion whose thickness between opposing sheets of the booklet, into which the suspension member has been inserted, gradually decreases upward, and the suspension member supports an inner surface of the booklet with the upwardly tapering portion.

12 Claims, 8 Drawing Sheets

(51) Int. Cl.

| | |
|---|---|
| ***B42C 1/12*** | (2006.01) |
| ***B42C 13/00*** | (2006.01) |
| ***G03G 15/00*** | (2006.01) |
| ***B65H 45/18*** | (2006.01) |
| *B31F 1/00* | (2006.01) |

(52) U.S. Cl.

CPC ..... *B65H 2301/44795* (2013.01); *B65H 2301/515* (2013.01); *G03G 2215/00936* (2013.01)

(56) References Cited

U.S. PATENT DOCUMENTS

| | | | | |
|---|---|---|---|---|
| 6,692,208 | B1 * | 2/2004 | Watkiss et al. | 412/1 |
| 7,178,799 | B2 * | 2/2007 | Wakabayashi et al. | 270/39.06 |
| 7,325,799 | B2 * | 2/2008 | Watkiss | 270/39.08 |
| 8,123,447 | B2 * | 2/2012 | Richter et al. | 412/4 |
| 8,186,663 | B2 | 5/2012 | Suzuki et al. | |
| 8,246,031 | B2 * | 8/2012 | Ramseier | 270/52.18 |
| 8,894,056 | B2 * | 11/2014 | Oshima | 270/52.26 |
| 8,944,426 | B2 * | 2/2015 | Kasuga et al. | 270/37 |
| 2006/0022393 | A1 * | 2/2006 | Trovinger | 270/52.26 |

FOREIGN PATENT DOCUMENTS

| | | | |
|---|---|---|---|
| JP | 2005-040890 | A | 2/2005 |
| JP | 2007-118518 | A | 5/2007 |
| JP | 2010-195582 | A | 9/2010 |
| JP | 2010-241112 | A | 10/2010 |
| JP | 2013018633 | A | 1/2013 |

* cited by examiner

POST-PROCESSING APPARATUS AND IMAGE FORMING SYSTEM

CROSS-REFERENCE TO RELATED APPLICATION

This application is based on Japanese Patent Application No. 2013-30339 filed on Feb. 19, 2013, the contents of which are incorporated herein by reference.

BACKGROUND

1. Technical Field

The present invention relates to a post-processing apparatus that performs various post-processing operations on a center-folded booklet, and an image forming system including the post-processing apparatus.

2. Description of Related Arts

In recent years, post-processing apparatuses for performing various post-processing operations on a printed sheet output from an image forming apparatus, such as a printer or an MFP, have been increasing used. The term "post-processing operations" refers to, for example, an operation of center-folding a sheet ("folding operation"), an operation of binding a plurality of sheets with a staple ("stapling operation"), an operation of cutting an edge of a booklet ("cutting operation"), and an operation of forming a spine of a booklet ("square folding operation"), and the like.

Referring to FIG. 9A, when performing a cutting operation on a center-folded booklet B, it is necessary to clamp the booklet B with clamps 371 and 372. In the process of transferring the booklet B to the clamps 371 and 372, the position of a fold F may become displaced from the central position in the booklet B in the thickness direction.

If a cutting operation is performed on the booklet B, which is clamped in a state in which the fold F has been displaced, a cut edge E of the booklet B becomes inclined with respect to the thickness direction, so that the appearance of the finished booklet B is not good (see FIG. 9B). Likewise, referring to FIGS. 10A and 10B, if a square folding operation is performed on the booklet B, which is clamped in a state in which the fold F has been displaced (FIG. 10A), the position of a staple S may become displaced from the central position in the thickness direction or the cut edge E may become inclined, so that, also in this case, the appearance of the finished booklet B is not good (FIG. 10B). In the present example, the square folding operation is performed by moving a roller R back and forth in directions perpendicular to the plane of FIGS. 10A and 10B.

Regarding this problem, Japanese Unexamined Publication Nos. 2007-118518, 2010-195582, and 2010-241112 describe post-processing apparatuses that clamp a booklet with clamp members after pressing an end of the booklet against contact members of various types. However, even with such post-processing apparatuses, if the booklet is too strongly pressed against the contact member, the end of the booklet may become deformed, so that it is difficult to appropriately correct displacement of a fold. Japanese Unexamined Publication No. 2005-040890 describes a post-processing apparatus that clamps a portion of a booklet near an edge with clamp members. The post-processing apparatus can perform a cutting operation with high precision, but cannot correct displacement of a fold.

The present invention has been achieved to address the problems of existing technologies described above. One of the objects of the present invention is to provide a post-processing apparatus that can correct displacement of a fold in the thickness direction of a booklet that is clamped by clamped members for various post-processing operations, and an image forming system including the post-processing apparatus.

SUMMARY

To achieve at least one of the above-mentioned objects, a post-processing apparatus reflecting one aspect of the present invention comprises a suspension member that suspends a center-folded booklet by being inserted into the booklet along a fold of the booklet, a pair of clamp members that are disposed so as to face outer surfaces of the booklet suspended by the suspension member and that clamp the booklet by moving closer to each other, and a post-processing mechanism that performs a post-processing operation on the booklet clamped by the clamp members. The suspension member includes an upwardly tapering portion whose thickness between opposing sheets of the booklet, into which the suspension member has been inserted, gradually decreases upward, and the suspension member supports an inner surface of the booklet with the tapering portion.

Preferably, the suspension member includes a flat plate-shaped body that is disposed below the tapering portion and an expanded portion that is disposed between the tapering portion and the body and whose thickness between the opposing sheets of the booklet is greater than that of the tapering portion; and the suspension member supports the inner surface of the booklet not only with the tapering portion but also with the expanded portion.

DETAILED DESCRIPTION

Hereinafter, embodiments of the present invention will be described in detail with reference to the drawings. The following description does not limit the scope of the invention and the meanings of the terms described in the claims.

Figure 1:
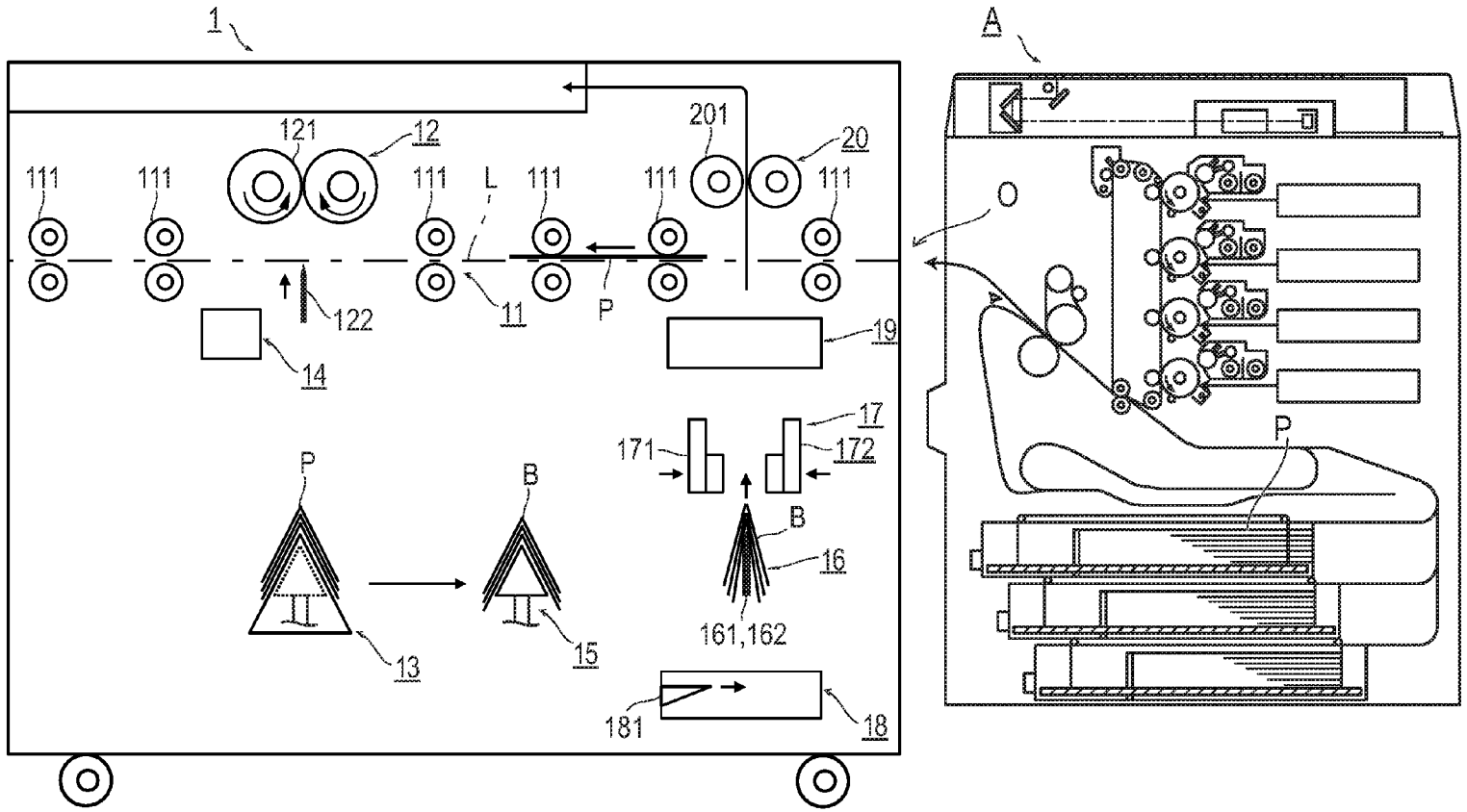
FIG. 1 is a schematic sectional view of a post-processing apparatus according to a first embodiment of the present invention.

FIG. 1 is a schematic sectional view illustrating the structure of a post-processing apparatus 1 according to a first embodiment of the present invention. Usually, the post-processing apparatus 1 is connected to an image forming apparatus A, which is a printer, an MFP, or the like. The post-processing apparatus 1 performs various post-processing operations on a printed sheet that has been output from the image forming apparatus A. The post-processing apparatus 1 and the image forming apparatus A constitute an image forming system that outputs a booklet on which a cutting operation, a square folding operation, and the like have been performed.

As illustrated in FIG. 1, the post-processing apparatus 1 includes a sheet transport unit 11, a folding unit 12, a stacking unit 13, a binding unit 14, a booklet transport unit 15, a suspension unit 16, a clamp unit 17, a cutting unit 18, a spine forming unit 19, and an output unit 20. The details of these units will be described below in this order.

The sheet transport unit 11 includes a plurality of transport rollers 111, which are arranged horizontally along a straight line, and driving means (not shown) that drives the transport rollers 111. The sheet transport unit 11 transports a printed sheet P, which has been supplied through a sheet supply port O, along a transport path L by driving the transport rollers 111. The folding unit 12 is disposed downstream of the sheet transport unit 11 along the transport path L.

The folding unit 12 is disposed above the transport path L. The folding unit 12 includes a pair of folding rollers 121 that are pressed against each other, a sheet folding knife 122 that is vertically movable, and driving means (not shown) that drives the components of the folding unit 12. The folding unit 12 performs a folding operation on the sheet P, which is transported along the transport path L, in cooperation with the sheet transport unit 11.

Figure 2:
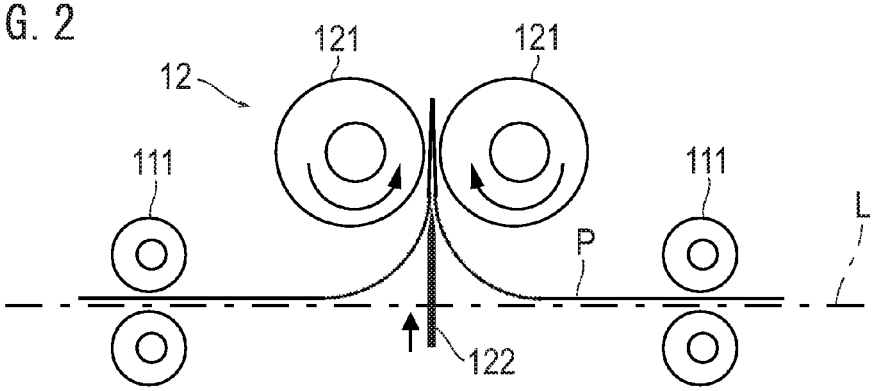
FIG. 2 is a schematic sectional view of a folding unit according to the first embodiment.

FIG. 2 is a schematic sectional view illustrating the structure of the folding unit 12. As illustrated in FIG. 2, when the sheet P reaches a position directly below the folding rollers 121, the sheet folding knife 122 is moved vertically upward to raise a central portion of the sheet P toward the folding rollers 121. At this time, the sheet P has been released from the transport rollers 111. Thus, the central portion of the sheet P is pressed into a nip between the folding rollers 121.

Next, the folding rollers 121 rotate in such directions as to pull the sheet P into the nip (in the directions of arrows in FIG. 2), thereby forming a fold in the central portion of the sheet P with a pressing force in the nip. Thus, an operation of folding (center folding) the sheet P is finished. The folding unit 12 may tri-fold the sheet P by using second folding rollers and a second sheet folding knife (not shown). When the folding operation has been finished, the folding rollers 121 rotate in reverse directions to release the sheet P. Thus, the folded sheet P is transferred to transport means (not shown), and the transport means transports the sheet P to the stacking unit 13.

The stacking unit 13 is disposed below the folding unit 12. The stacking unit 13 has an upwardly convex shape corresponding to the shape of an inner surface of the folded sheet P. For example, the stacking unit 13 has a triangular-prism shape extending in a horizontal direction. The transport means successively transports the sheets P, and the sheets P are stacked on an upper surface of the stacking unit 13 in a "saddle-straddling" manner. A set of the sheets P that are stacked in this manner will be referred to as a "booklet B". The binding unit 14 is a stapler for binding the booklet B placed on the stacking unit 13. Transport means (not shown) transports the booklet B, which is placed on the stacking unit 13, to the booklet transport unit 15.

The booklet transport unit 15 is disposed adjacent to the stacking unit 13. The booklet transport unit 15 includes a transport member 151, a slide member 152, and a slide rail 153 (see FIG. 3). For example, the booklet transport unit 15 is disposed in front of the stacking unit 13 in the direction perpendicular to the plane of FIG. 1. The booklet transport unit 15 transports the booklet B, which has been received from the stacking unit 13, to a position directly below the clamp unit 17.

Figure 3:
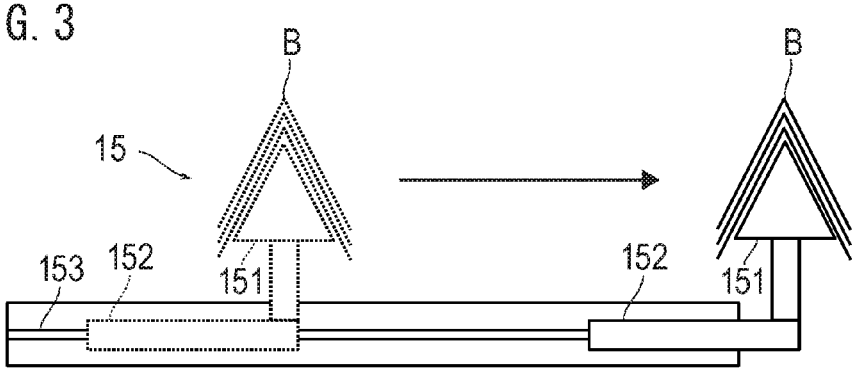
FIG. 3 is a schematic sectional view of a booklet transport unit according to the first embodiment.

FIG. 3 is a schematic side view illustrating the structure of the booklet transport unit 15. As illustrated in FIG. 3, as with the stacking unit 13, the transport member 151 has a shape that extends in a horizontal direction and that is upwardly convex (such as a triangular prism shape). The booklet B, which has been transported from the stacking unit 13, is placed on the transport member 151. The slide member 152 is connected to a lower portion of the transport member 151 and is engaged with the slide rail 153, which extends in a horizontal direction. The booklet transport unit 15, which has such a structure, causes driving means (not shown) to slide the slide member 152 along the slide rail 153. Thus, the booklet B, which is placed on the transport member 151, is transported in the horizontal direction and transferred to the suspension unit 16.

The suspension unit 16 includes a pair of suspension members 161 and 162 and driving means (not shown) that drives the components of the suspension unit 16. The suspension unit 16 suspends the booklet B placed on the transport member 151 with the pair of suspension members 161 and 162, and, in this state, moves the suspension members 161 and 162 vertically upward. Thus, the booklet B is transported vertically upward and transferred to the clamp unit 17. In the present embodiment, the term "suspend" refers to an operation of supporting an inner surface of a folded booklet by inserting a member along the fold of the booklet. The same applies to a second embodiment described below.

Figure 4A:
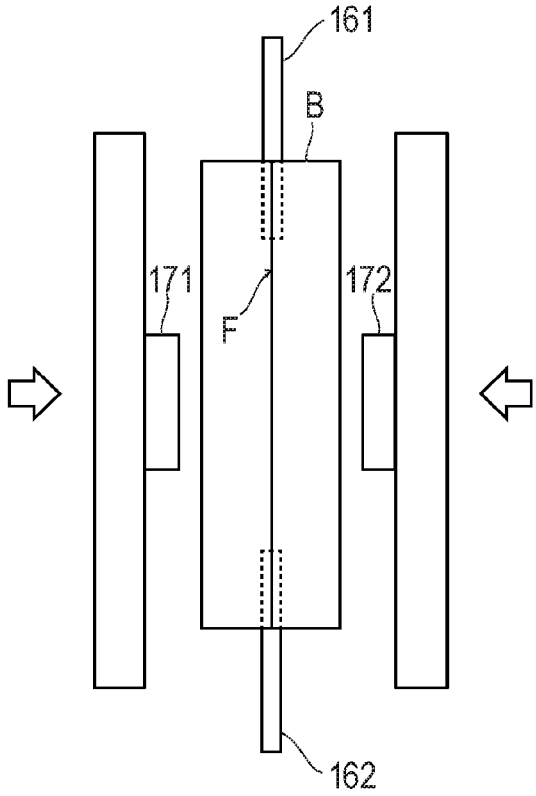
FIG. 4A is a top view of an example of a suspension member according to the first embodiment.
Figure 4B:
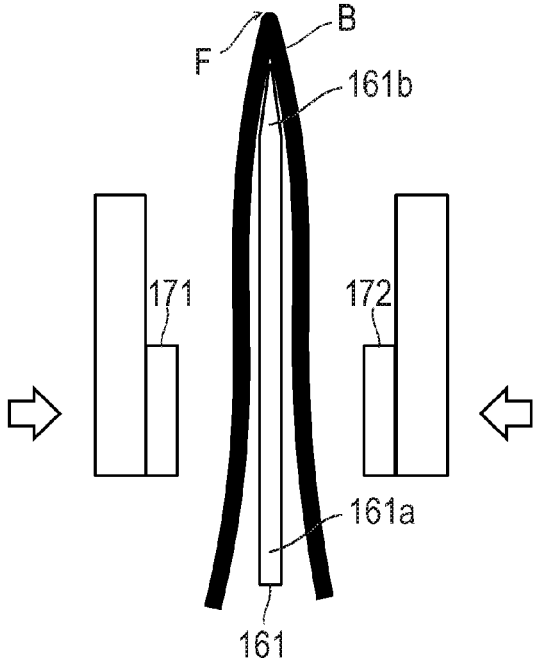
FIG. 4B is a side view of the example of the suspension member according to the first embodiment.

FIGS. 4A and 4B are schematic views illustrating the structure of the pair of suspension members 161 and 162 according to the present embodiment. FIG. 4A is a top view, and FIG. 4B is a side view. As illustrated in FIG. 4A, the pair of suspension members 161 and 162 are arranged in a horizontal direction and suspend the booklet B by being inserted into the booklet B from both sides of a fold F of the booklet B. Because the shapes of the pair of suspension members 161 and 162 are symmetrical to each other, only the structure of the suspension member 161 will be described below.

As illustrated in FIGS. 4A and 4B, the suspension member 161 has a substantially plate-like shape corresponding to the fold F of the booklet B. To be specific, the suspension member 161 includes a flat plate-shaped body 161*a* and a tapering portion 161*b* disposed above the body 161*a*. As illustrated in FIG. 4B, the tapering portion 161*b* has an upwardly tapering shape whose thickness between opposing sheets of the booklet B (that is, the thickness in the left-right direction of FIG. 4B) gradually decreases upward.

Preferably, the thickness of an upper end portion of the tapering portion 161*b* is, for example, less than 0.5 mm. The suspension member 161, which has such a shape, suspends the booklet B by supporting an inner surface of the booklet B with the upwardly tapering portion 161*b*. Thus, the suspension member 161 according to the present embodiment can correct displacement of the fold F in the thickness direction of the booklet B (that is, in the left-right direction of FIG. 4B).

Referring back to FIG. 1, the clamp unit 17 includes a pair of clamp members 171 and 172 that are a pair of clamps or the like arranged in a horizontal direction, and driving means that drives the components of the clamp unit 17. As illustrated in FIGS. 1, 4A, and 4B, the clamp unit 17 clamps the booklet B by moving the pair of clamp members 171 and 172 closer to each other. When the booklet B has been clamped between the pair of clamp members 171 and 172, transfer of the booklet B from the suspension unit 16 to the clamp unit 17 is finished. A process of transferring the booklet B will be specifically described below.

(i) First, when the booklet transport unit 15 has transported the booklet B to a position directly below the clamp unit 17, the pair of suspension members 161 and 162 are inserted into the booklet B from both sides of the fold F. Thus, the booklet B is suspended. (ii) Next, the pair of suspension members 161 and 162, which are suspending the booklet B, move vertically upward. Thus, the booklet B is transported vertically upward and disposed so that an upper end portion of the booklet B is located between the pair of clamp members 171 and 172. (iii) Finally, the pair of clamp members 171 and 172 move closer to each other and clamp the upper end portion of the booklet B.

In the operation described in (i), displacement of the fold F of the booklet B is corrected by the pair of suspension members 161 and 162. In the operation described in (ii), the booklet B is transported upward until the upper end of the booklet B protrudes from the pair of clamp members 171 and 172. When the booklet B has been transferred through the process described in (i) to (iii), the pair of suspension members 161 and 162 move away from each other so as to be separated from the booklet B. In order allow the suspension members 161 and 162 to be separated from the booklet B, the pair of clamp members 171 and 172 clamp only a central portion of the booklet B in a direction along the fold F (that is, in the vertical direction in FIG. 4A).

Referring back to FIG. 1, the cutting unit 18 is disposed below the clamp unit 17. The cutting unit 18 includes a cutting blade 181 for cutting the booklet B and driving means (not shown) for driving the components of the cutting unit 18. The cutting unit 18 moves the cutting blade 181 along an edge E of the booklet B clamped by the clamp unit 17. Thus, an operation of cutting the booklet B is finished. During this operation, the edge E of the booklet B does not become inclined with respect to the thickness direction, because displacement of the fold F of the booklet B has been corrected.

The spine forming unit 19 is disposed above the clamp unit 17. The spine forming unit 19 forms a back surface (spine) of the booklet B by moving a pressure roller (not shown) along the fold of the booklet B clamped by the clamp unit 17. Thus, an operation of square folding the booklet B is finished. During this operation, the back surface of the booklet B does not become deformed and the edge E of the booklet does not become inclined with respect to the thickness direction, because displacement of the fold F of the booklet B has been corrected. In the present example, the square folding operation is performed by moving the pressure roller back and forth in directions perpendicular to the plane of FIG. 1.

The output unit 20 is disposed above the clamp unit 17. The output unit 20 includes output rollers 201 for outputting the booklet B and driving means (not shown) for driving the components of the output unit 20. The output unit 20 outputs the post-processed booklet B to the outside of the post-processing apparatus 1 by driving the output rollers 201.

As described above, the suspension member 161 of the post-processing apparatus 1 according to the present embodiment includes the upwardly tapering portion 161*b*, whose thickness between opposing sheets of the center-folded booklet B, into which the suspension member 161 is inserted along the fold F of the booklet B, gradually decreases upward. Because the suspension member 161 according to the present embodiment supports an inner surface of the booklet B with the tapering portion 161*b*, the suspension member 161 can correct displacement of the fold F the booklet B, which is clamped by the clamp members 171 and 172, in the thickness direction.

Preferably, a frictional force generated between the tapering portion 161*b* and the inner surface of the booklet B is minimized for the purpose of more reliably correcting displacement of the fold F of the booklet B. For this purpose, preferably, for example, the tapering portion 161*b* is coated with a synthetic resin having a small friction coefficient. In this case, the synthetic resin coating is formed at least on a part of the tapering portion 161*b* that contacts the booklet B. An example of such a synthetic resin is a fluorocarbon resin, such as Teflon (registered trademark). The synthetic resin coating is formed by, for example, affixing a Teflon (registered trademark) tape to the tapering portion 161*b*.

For the purpose described above, preferably, for example, an upper end portion of the tapering portion 161*b* is formed as an upwardly convex curved surface, or the tapering portion 161*b* be surface-treated so as to have a low friction coefficient.

In the latter case, at least apart of the tapering portion 161*b* that contacts the booklet B is surface-treated.

Figure 5A:
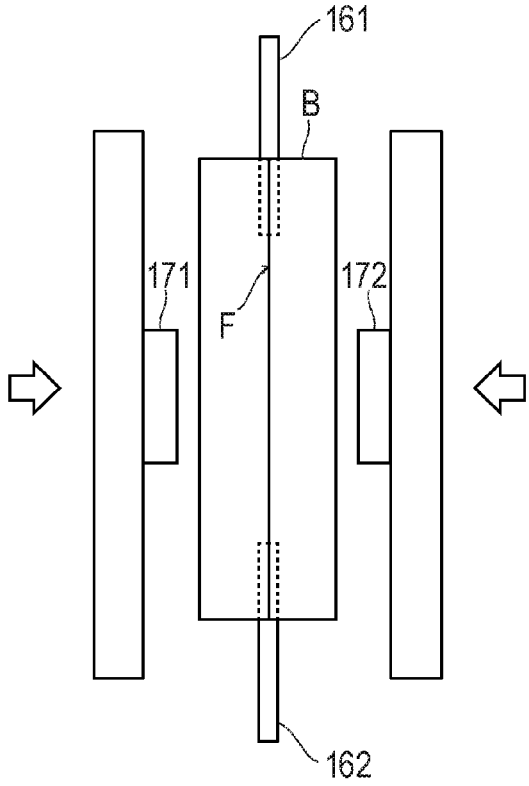
FIG. 5A is a top view of an example of a suspension member according to a second embodiment.
Figure 5B:
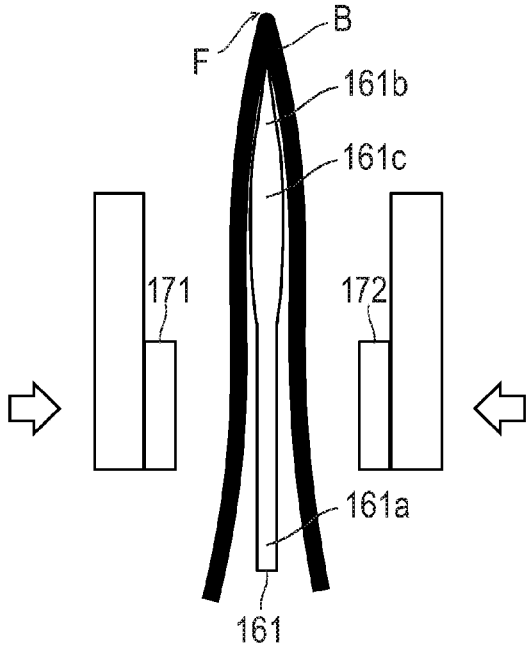
FIG. 5B is a side view of the example of the suspension member according to the second embodiment.

Next, a second embodiment of the present invention will be described. FIGS. 5A and 5B are schematic views of an example of a suspension member according to the present embodiment. FIG. 5A is a top view, and FIG. 5B is a side view. Except for the points described below, the post-processing apparatus according to the present embodiment has the same function and the same structure as those of the post-processing apparatus 1 according to the first embodiment. Therefore, the numerals the same as those of the first embodiment will be used to refer to the components of the post-processing apparatus.

As illustrated in FIG. 5B, the suspension member 161 according to the present embodiment includes the flat plate-shaped body 161*a*, the tapering portion 161*b* disposed above the body 161*a*, and, in addition, an expanded portion 161*c* disposed between the body 161*a* and the tapering portion 161*b*.

As illustrated in FIG. 5B, the expanded portion 161*c* has a shape that it is expanded in the thickness direction (that is, in the left-right direction) so that the thickness of the expanded portion between opposing sheets of the booklet B is greater than those of the body 161*a* and the tapering portion 161*b*. The suspension member 161 according to the present embodiment supports an inner surface of the booklet B not only with the tapering portion 161*b* but also with the expanded portion 161*c*. Thus, a bulge in the thickness direction is formed in a portion of the booklet B corresponding to the expanded portion 161*c*. This bulge will be further described below.

The expanded portion 161*c* according to the present example is integrally formed with the body 161*a* and the tapering portion 161*b* from a rigid material having an appropriate rigidity. To be specific, the expanded portion 161*c* is made of a material having a rigidity with which the position of the fold F can be appropriately maintained. Examples of such a material include a metal material, such as a stainless steel, and a resin material, such as a polyacetal.

With the present embodiment, a bulge corresponding to the expanded portion 161*c* is formed in a portion of the booklet B below the fold F. Such a bulge is effective in preventing the vicinity of the fold F from becoming creased when the booklet B is clamped. Therefore, preferably, the pair of clamp members 171 and 172 according to the present embodiment clamp the booklet B at a position corresponding the body 161*a* so as not to cause the bulge of the booklet B to collapse (that is, at a position below the expanded portion 161*c*).

Figure 8A:
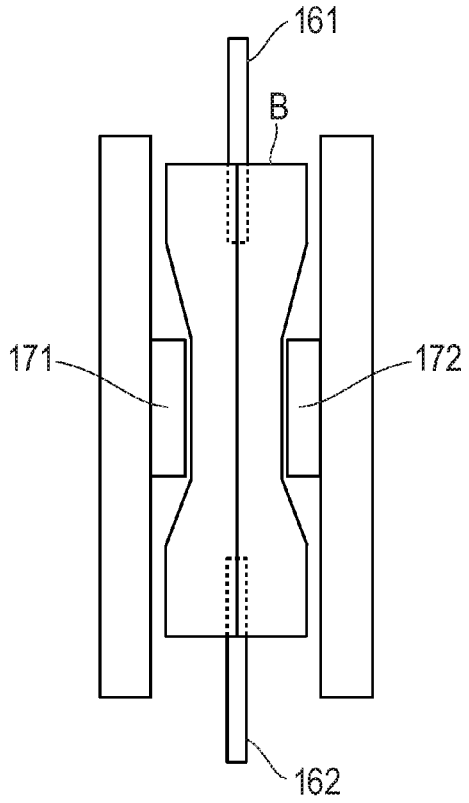
FIG. 8A is a schematic top view of an example of a case where a booklet is clamped at a position corresponding not to a body but to an expanded portion.
Figure 8B:
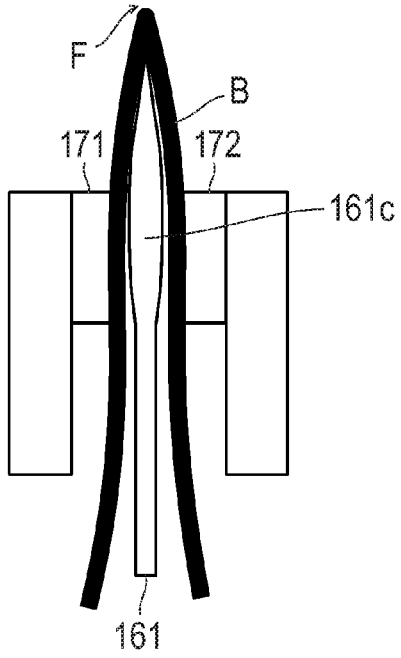
FIG. 8B is a schematic side view of the example of the case where the booklet is clamped at the position corresponding not to the body but to the expanded portion.
Figure 9A:
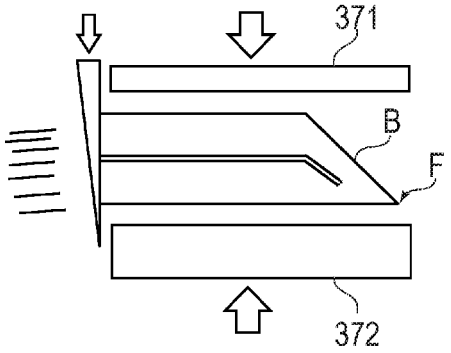
FIG. 9A RELATED ART
FIG. 9A is a schematic side view illustrating displacement of a fold that occurs when an existing post-processing apparatus is used.
Figure 9B:
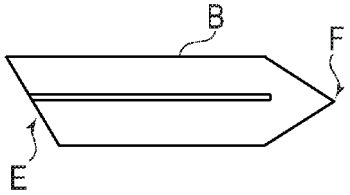
FIG. 9B RELATED ART
FIG. 9B is a schematic side view illustrating displacement of a fold that occurs when an existing post-processing apparatus is used.
Figure 10A:
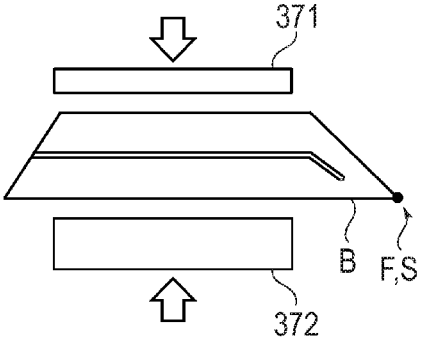
FIG. 10A RELATED ART
FIG. 10A is a schematic side view illustrating displacement of a fold that occurs when an existing post-processing apparatus is used.
Figure 10B:
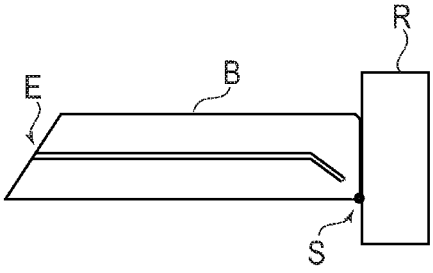
FIG. 10B RELATED ART
FIG. 10B is a schematic side view illustrating displacement of a fold that occurs when an existing post-processing apparatus is used.

FIGS. 8A and 8B are schematic views illustrating an example of a case where the booklet B is clamped at a position corresponding not to the body 161*a* but to the expanded portion 161*c*. FIG. 8A is a top view, and FIG. 8B is a side view. As illustrated in FIG. 8B, when the booklet B is clamped at a position corresponding to the expanded portion 161*c*, the bulge of the booklet B collapses and a strong tension is applied in the vicinity of the fold F. Thus, a crease is likely to be formed in the vicinity of the fold F, and the appearance of the finished booklet B may not be good. In the example shown in FIG. 5B, the booklet B is clamped at a position corresponding to the body 161*a*, which is disposed below the expanded portion 161*c*. In the example illustrated in FIGS. 5A and 5B, the bulge of the booklet corresponding to the expanded portion 161*c* is maintained when the booklet B is clamped, so that generation of a crease in the vicinity of the fold F of the booklet B can be effectively prevented.

Figure 6A:
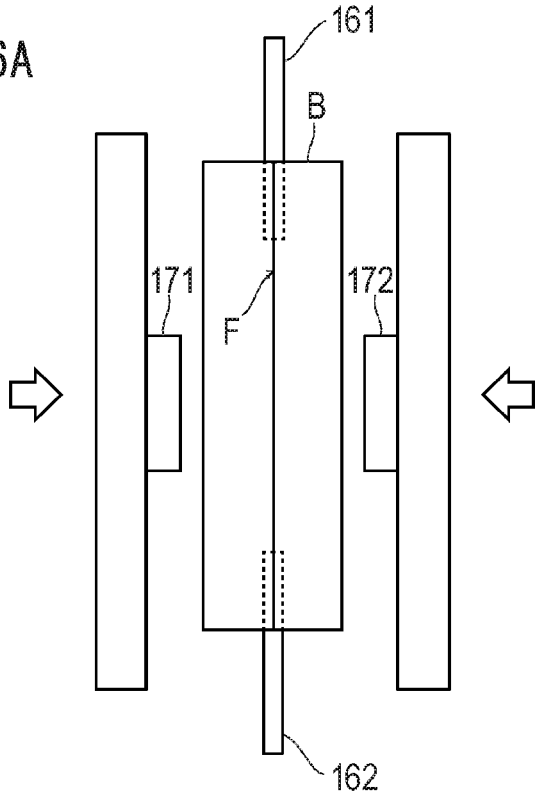
FIG. 6A is a top view of another example of the suspension member according to the second embodiment.
Figure 6B:
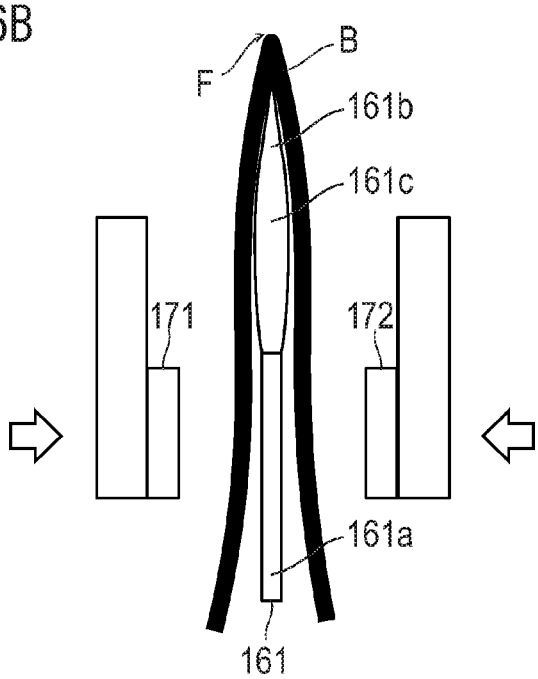
FIG. 6B is a side view of the other example of the suspension member according to the second embodiment.

FIGS. 6A and 6B are schematic views of another example of the suspension member 161 according to the present embodiment. FIG. 6A is a top view, and FIG. 6B is a side view. The body 161*a* according to the present example is made from a rigid material having an appropriate rigidity. To be specific, the body 161*a* is made of a material having a rigidity with which the position of the fold F can be appropriately maintained. Examples of such a material include a metal material, such as a stainless steel, and a resin material, such as a polyacetal.

The tapering portion 161*b* and the expanded portion 161*c* are integrally formed from an elastic material having an elastic modulus smaller than that of the body 161*a*. To be specific, the tapering portion 161*b* and the expanded portion 161*c* are made of a material having an elasticity with which they deform to an appropriate degree in accordance with a pressure from the inner surface of the booklet B. Examples of such a material include a rubber and a sponge-like material. (Preferably, the friction drag of the surfaces of the tapering portion 161*b* and the expanded portion 161*c* is low.) The suspension member 161 according to the present example can be more stably suspend the booklet B, because the expanded portion 161*c* closely contacts the inner surface of the booklet B.

Figure 7A:
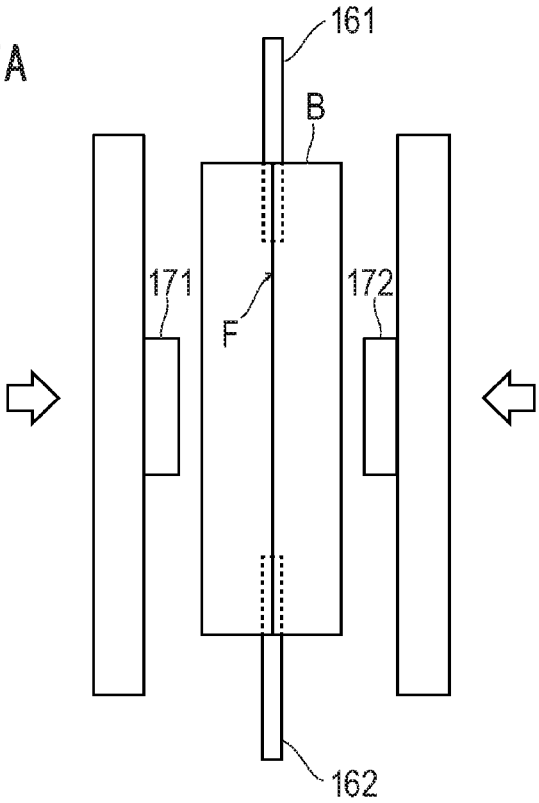
FIG. 7A is a top view of another example of the suspension member according to the second embodiment.
Figure 7B:
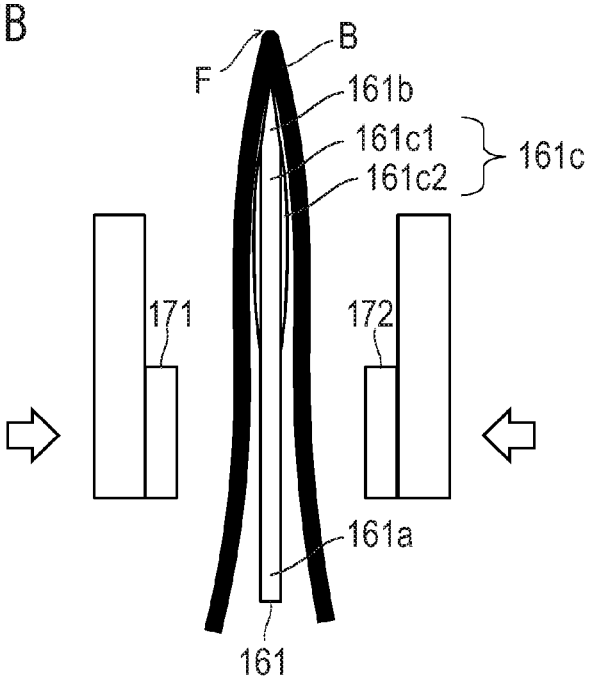
FIG. 7B is a side view of the other example of the suspension member according to the second embodiment.

FIGS. 7A and 7B are schematic views illustrating still another example of the suspension member 161 according to the present embodiment. FIG. 7A is a top view, and FIG. 7B is a side view. In the present example, the expanded portion 161*c* includes a flat plate-shaped core portion 161*c*1 and a cover portion 161*c*2 affixed to a surface of the core portion 161*c*1.

The core portion 161*c*1 is integrally formed with the body 161*a* and the tapering portion 161*b* from a material having an appropriate rigidity. To be specific, the core portion 161*c*1 is made of a material having a rigidity with which the position of the fold F can be appropriately maintained. Examples of such a material include a metal material, such as a stainless steel, and a resin material, such as an ABS resin.

The cover portion 161*c*2 is made of an elastic material having an elastic modulus smaller than that of the core portion 161*c*1. To be specific, the cover portion 161*c*2 is made of a material having an elasticity with which the cover portion 161*c*2 deforms to an appropriate degree in accordance with a pressure applied from the inner surface of the booklet B. Examples of such a material include a rubber and a sponge-like material. (Preferably, the friction drag of the surface of the cover portion 161*c*2 is low.) The suspension member 161 according to the present example can be more stably suspended the booklet B, because the tapering portion 161*b* strongly holds the fold F of the booklet B and the expanded portion 161*c* closely contacts the inner surface of the booklet B.

As described above, the suspension member 161 of the post-processing apparatus 1 according to the present embodiment includes the expanded portion 161*c*, which is disposed between the body 161*a* and the tapering portion 161*b* and whose thickness between opposing sheets of the booklet B is greater than those of the body 161*a* and the tapering portion 161*b*. The suspension member 161 according to the present embodiment supports an inner surface of the booklet B not only with the tapering portion 161*b* but also with the expanded portion 161*c*. Therefore, the suspension member 161 can more reliably correct displacement of the fold F in the thickness direction of the booklet B, which is clamped by clamp members for various post-processing operations.

The present invention is not limited to the embodiments described above and can be modified in various ways within the scope of the invention described in the claims. For example, in the embodiments described above, the pair of suspension members 161 and 162 are inserted into the booklet B from both sides of the booklet B. Alternatively, a single suspension member may suspend a booklet by being inserted into the booklet from only one side of the booklet. The dimensions, the shapes, and the materials of the components described above are only examples, and various other dimensions, shapes, and materials may be used in order to achieve the effects of the present invention.

What is claimed is:

1. A post-processing apparatus comprising:

a suspension member that suspends a center-folded booklet by being inserted into the booklet along a fold of the booklet;

a pair of clamp members that are disposed so as to face outer surfaces of the booklet suspended by the suspension member and that clamp the booklet by moving closer to each other; and a post-processing mechanism that performs a post-processing operation on the booklet clamped by the clamp members, wherein the suspension member includes an upwardly tapering portion whose thickness between opposing sheets of the booklet, into which the suspension member has been inserted, gradually decreases upward, and the suspension member supports an inner surface of the booklet with the tapering portion, wherein the suspension member further includes a flat plate-shaped body that is disposed below the tapering portion and an expanded portion that is disposed between the tapering portion and the body and whose thickness between the opposing sheets of the booklet is greater than that of the tapering portion, and wherein the suspension member supports the inner surface of the booklet not only with the tapering portion but also with the expanded portion.

2. The post-processing apparatus according to claim 1, wherein the tapering portion and the expanded portion are integrally formed from the same material.

3. The post-processing apparatus according to claim 2, wherein the body is made of a material having an elastic modulus greater than that of the material of the tapering portion and the expanded portion.

4. The post-processing apparatus according to claim 1, wherein the expanded portion includes a flat plate-shaped core portion that is integrally formed with the tapering portion and the body from the same material and a cover portion that is affixed to a surface of the core portion, and wherein the cover portion is made of a material having an elastic modulus smaller than that of a material of the core portion.

5. The post-processing apparatus according to claim 1, wherein the clamp members clamp the booklet at a position below the expanded portion.

6. The post-processing apparatus according to claim 1, wherein a coating made of a fluorocarbon resin is formed on the tapering portion.

7. The post-processing apparatus according to claim 1, wherein the tapering portion is surface-treated so as to have a low friction coefficient.

8. The post-processing apparatus according to claim 1, wherein an upper end portion of the tapering portion has an upwardly convex curved surface.

9. The post-processing apparatus according to claim 1, wherein a thickness of an upper end portion of the tapering portion between the opposing sheets of the booklet is less than 0.5 mm.

10. The post-processing apparatus according to claim 1, wherein the post-processing operation includes at least one of an operation of cutting an edge of the booklet and an operation of forming a spine of the booklet.

11. An image forming system comprising:

a post-processing apparatus including:

a suspension member that suspends a center-folded booklet by being inserted into the booklet along a fold of the booklet, a pair of clamp members that are disposed so as to face outer surfaces of the booklet suspended by the suspension member and that clamp the booklet by moving closer to each other, and a post-processing mechanism that performs a post-processing operation on the booklet clamped by the clamp members, wherein the suspension member includes an upwardly tapering portion whose thickness between opposing sheets of the booklet, into which the suspension member has been inserted, gradually decreases upward, and the suspension member supports an inner surface of the booklet with the tapering portion, wherein the suspension member further includes a flat plate-shaped body that is disposed below the tapering portion and an expanded portion that is disposed between the tapering portion and the body and whose thickness between the opposing sheets of the booklet is greater than that of the tapering portion, and wherein the suspension member supports the inner surface of the booklet not only with the tapering portion but also with the expanded portion; and an image forming apparatus that outputs printed sheets for forming the booklet and supplies the printed sheets to the post-processing apparatus.

12. The image forming system according to claim 11, wherein the clamp members clamp the booklet at a position below the expanded portion.

* * * * *